US005103638A

United States Patent [19]

Roberts et al.

[11] Patent Number: 5,103,638

[45] Date of Patent: Apr. 14, 1992

[54] MOUNTING ARRANGEMENT

[75] Inventors: Martyn G. Roberts, Roswell; Douglas J. Nightingale, Jonesboro, both of Ga.

[73] Assignee: Rolls-Royce Inc., Atlanta, Ga.

[21] Appl. No.: 471,634

[22] Filed: Jan. 29, 1990

[51] Int. Cl.[5] ..... F02K 3/10

[52] U.S. Cl. ..... 60/261; 60/749; 60/39.31; 60/39.32; 267/229

[58] Field of Search ..... 60/261, 262, 241, 749, 60/39.04, 39.161, 39.31, 39.32; 267/158, 160, 229

[56] References Cited

U.S. PATENT DOCUMENTS

| | | | |
|---|---|---|---|
| 2,876,891 | 3/1959 | Long et al. | 267/158 |
| 3,190,632 | 6/1965 | Barenyl | 267/158 |
| 3,295,325 | 1/1965 | Nelson, Jr. | 60/261 |
| 4,064,691 | 12/1977 | Nash | 60/261 |
| 4,592,200 | 6/1986 | Benoist et al. | 60/261 |
| 4,724,671 | 2/1988 | Lepergue et al. | 60/261 |
| 4,899,539 | 2/1990 | Gastebois et al. | 60/261 |
| 4,901,527 | 2/1990 | Nash et al. | 60/261 |

*Primary Examiner*—Richard A. Bertsch
*Assistant Examiner*—Alfred Basichas
*Attorney, Agent, or Firm*—Oliff & Berridge

[57] ABSTRACT

A mounting arrangement for a composite material flameholder in teh reheat system of a gas turbine engine provides for a flameholder to be suspended from a flameholder bracket in the jet pipe by a means of pivotal mounting and to be restrained from movement by a leaf spring mounted trunnion attached between the bracket and the flameholder at a second mounting spaced a short distance away from the first. The resilience of the leaf spring allows movement in directions parallel to a line through the axes of the two mountings in order to accommodate differential thermal growth of the composite flameholders and their metallic supporting structure.

5 Claims, 2 Drawing Sheets

MOUNTING ARRANGEMENT

The invention relates to an arrangement for mounting a component with respect to a support structure having a relatively high coefficient of differential thermal expansion. In particular, it concerns a mechanical mounting arrangement for a composite or non-metallic flameholder in the reheat system of a gas turbine engine.

An example of an arrangement of the type referred to is to be found in the reheat system of gas turbine engines. Future generations of reheated gas turbine engines will operate at higher turbine exit temperatures which will necessitate the use of higher temperature tolerant flameholders. A flameholder is a shaped member which projects into the hot gas stream downstream of the reheat fuel manifolds. There are a plurality of such flameholders and these provide in their lee regions in which turbulent eddies are formed to assist combustion. The local gas velocity is reduced in the wake of the flameholders to a level at which flames in the reheat cycle become stable. Without these flames stabilisers the reheat system will not function smoothly nor burn steadily over a range of mixture strengths and gas velocities.

This invention concerns the use of components, especially flameholders, constructed of non-metallic materials, for example, carbon/carbon composites. However, it will be appreciated that the invention will find wider application than merely as gas turbine engine components.

According to one aspect of the invention there is provided an arrangement for mounting a component with respect to a support structure having a relatively high differential coefficient of expansion, the arrangement comprising:

a component adapted for cantilever mounting having an end formed with two mounting holes having axes parallel to each other and spaced apart by a short distance, a support structure provided with load bearing means adapted to engage pivotally one of the mounting holes, and resilient restraining means anchored to the support structure and an opposite end pivotally engaged with the second mounting hole.

According to a further aspect of the invention there is provided an arrangement for mounting a member with respect to a supporting structure in the jet pipe of a gas turbine engine, the arrangement comprising:

a non-metallic member adapted for cantilever mounting having an end formed with two mounting holes having axis parallel to each other and spaced apart by a short distance, a metallic support structure fixed in the jet pipe provided with load bearing means adapted to pivotally engage one of the mounting holes, and a flexible but substantially inextendible ligament one end of which is anchored to the metallic support structure and an opposite end pivotally engaged with the second mounting hole.

Figure 1:
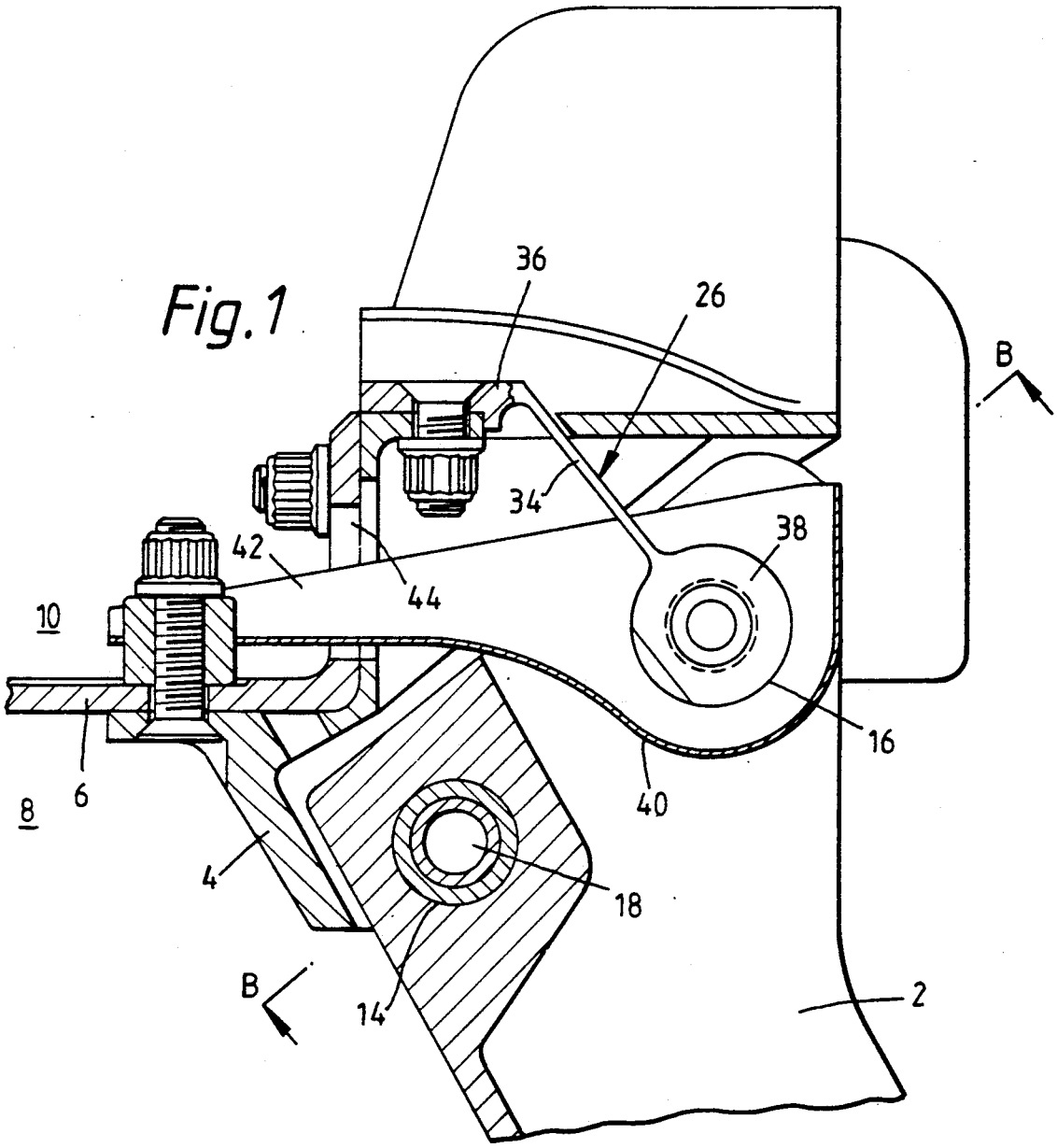
Figure 2:
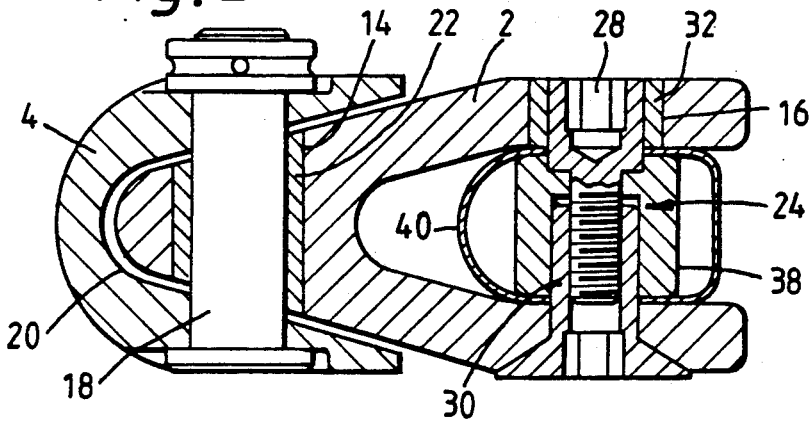
Figure 3:
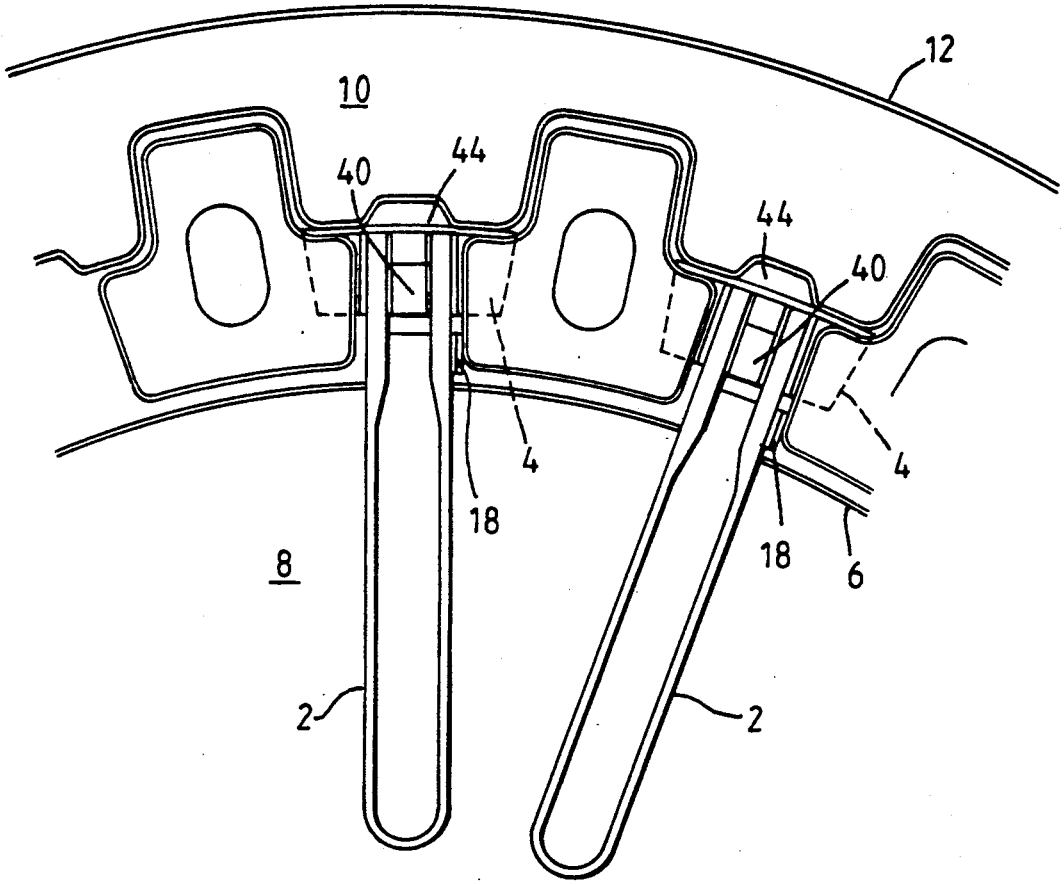

The invention and how it may be carried into practice will now be described in greater detail with reference, by way of example only, to the arrangement illustrated in the accompanying drawings, in which:

FIG. 1 shows a view of the mechanical mounting arrangement of a reheat flameholder in a gas turbine engine in the section AA of FIGS. 2 and 3, FIG. 2 shows a view of the mounting on the section BB of FIG. 1, and FIG. 3 shows a view of a segment of a reheat flameholder ring from aft looking forward.

Referring now to the drawings, a flameholder 2 is pivotally mounted on a cantilever support bracket 4. The flameholder 2 as already mentioned, is part of the reheat system of a gas turbine engine. The reheat fuel injectors, which form no part of the present invention, have been omitted from the drawings but would be located upstream of the flameholders, that is generally to the left in FIGS. 1 and 2 and in the viewing direction in FIG. 3. The bracket 4 is mounted at the rearward end of an annular liner 6 separating a core engine hot gas path 8 from the relatively cooler air of an engine bypass duct 10. A plurality of the flameholders 2 is disposed in an annular array such that they project radially inwards within the jet pipe downstream of the low pressure turbine (also not shown). The jet pipe is indicated at 12 in FIG. 3.

Increased turbine exit temperatures result in the flameholders 2 being subjected not only to greater thermal stresses but to a general environment significantly more hostile towards metal alloy materials from which the flameholders are conventionally constructed. The solution adopted is substitution of seriously affected material by alternatives less susceptible to the extremes of the conditions encountered. For the flameholders non-metallic materials such as carbon/carbon composites have been selected.

However, straightforward new component for old component substitution is not feasible because of the substantially different thermal growth characteristics of the new components. Increased heat transfer into the inner duct liner 6 as a result of the higher gas temperatures can be compensated by an increased volume of cooling air taken from the surrounding bypass duct 10 in the cooler side of the liner. Although the mountings may be cooled the flameholders have to withstand the increased temperatures. The new materials, however, possess substantially lower coefficients of thermal expansion than the metal used for the duct liner 6 and the support mounting 4. The consequential differential thermal expansion has to be allowed for in the design of the mountings.

A flameholder 2 consists of an elongate member which over a substantial proportion of its length at least is in the form of V-shape gutter in section. The open side of the gutter faces downstream, that is in the direction of gas flow and towards the engine exhaust nozzle. The radially outermost end of the flameholder by which it is mounted, that is its proximal end, is solid. The walls may become thicker and the depth of the gutter is progressively diminished so that the thicker walls on either side of the gutter recess converge to form the solid end.

Each flameholder at its proximal end has two mounting holes 14, 16. The first of these 14 is formed through the solid portion of member to receive a load bearing mounting pin 18 which is carried by the support bracket 4.

FIG. 2 which shows a transverse section of the mounting arrangement on the section BB of FIG. 1 illustrates the pivotal mounting of the flameholder more clearly. The bracket 4 has a recessed portion 20 for receiving the flameholder which is of complementary shape, that is, it is generally V-shaped in transverse section with the open side of the V-shaped recess 20 facing downstream. The flanks of the V-shaped bracket have holes formed in them opposite each other to receive the mounting pin 18.

The flameholder 2 is provided with a ceramic wear bush 22 in hole 14 to reduce surface, ie Hertzian, stress on the carbon/carbon material and to avoid wear of a surface coating due to relative movement of the pin 18. Thus, within strict limits imposed by the clearance between the flameholder 2 and the support bracket 4 the pin 18 pivotally mounts the flameholder relative to the support structure.

The second mounting hole 16 is formed in the flameholder parallel to the first hole 14 and spaced apart therefrom. The width of the flameholder in the described embodiment is increased towards the mounting end to increase the permissible spacing between the mounting holes. This second mounting hole is pivotally engaged by means of a constant torque type of fastener 24 with an inextensible ligament means 26.

The fastener 24 comprises a bolt 28 screwed into a threaded sleeve 30. The head of bolt 28 is engaged in a ceramic wear bush 32 retained in the hole 16 in one sidewall of the flameholder. The sleeve 30 has a countersunk head seated in a countersunk entry to hole 16 in the opposite sidewall of the flameholder. During assembly the fastener 24 is tightened to a predetermined torque, its design ensures that the bolt preload is maintained at all operating conditions.

The fastener 24 engages the ligament means 26 which comprises a leaf spring mounted trunnion. The means 26 consists of a thin flexible centre section 34 with relatively thicker rigid ends 36, 38. One end 36 in anchored to the bracket 4 carried by the support structure while the other end is located in the V-shaped recess of the flameholder and is engaged by the fastener 24. The lack of extensibility of the ligament means 26 acts to restrain the flameholder 2 from pivotal movement about the mounting pin 18. However, the flexibility of the resilient centre section 34 permits a limited amount of relative movement of the pin 18 and bolt 28 in the plane common to their axes. This enables the leaf spring to accommodate differential growth due to inequality of the thermal expansion coefficients of the materials employed.

A heat shield or shroud means 40 in the form of an air scoop is provided to protect the restraining leaf spring 26 and the trunnion mounting from the worst effects of the combustion temperatures. The shield 40 comprises a simple pressing or sheet metal fabrication in the form of a scuttle mounted on the trunnion co-axially with the fastener 24. Side portions of the shield are pierced to allow the fastener 24 to pass through and the lower face is shaped to pass below and partially around the fastener and spaced apart from the trunnion end of the mounting to form an air passage between it and the hottest combustion regions.

The shield is also formed with a forwardly extending portion 42 which is disposed in a longitudinal direction, relative to the axis of the engine. A radial flange part of the annular bracket 4 upon which the plurality of flameholders is mounted is pierced adjacent each flameholder location by one of a plurality apertures 44 spaced apart circumferentially around the jet pipe. Each such aperture 44 provides passage for cooling air from the engine bypass duct 10 to reach the trunnion mounting. The extended portion 42 of a heat shield projects through each one of the said apertures and acts as an airscoop thereby ducting cooling air to the trunnion mounting and to cool the leaf spring.

We claim:

1. An arrangement for mounting a component with respect to a support structure having a relatively high differential coefficient of expansion, the arrangement comprising:

a component adapted for cantilever mounting having an end formed with two mounting holes having axes parallel to each other and spaced apart, a support structure provided with load bearing means adapted to engage pivotally one of the mounting holes, and resilient restraining means in the form of a leaf spring, one end of which is anchored to the support structure and an opposite end of which is pivotally engaged with the second mounting hole, said leaf spring having a flexible thin section transverse to a plane intersecting the mounting holes and rigid ends for attachment at one end to the support structure and at the other end to the component.

2. An arrangement for mounting a member with respect to a supporting structure in the jet pipe of a gas turbine engine, the arrangement comprising:

a non-metallic member adapted for cantilever mounting having an end formed with two mounting holes having axes parallel to each other and spaced apart, a metallic support structure fixed in the jet pipe and provided with load bearing means adapted to pivotally engage one of the mount holes, and a flexible but substantially inextensible ligament in the form of a leaf spring one end of which is anchored to the metallic support structure and an opposite end of which is pivotally engaged with the second mounting hole, said leaf spring having a flexible thin section transverse to a plane intersecting the mounting holes and rigid ends for attachment at one end to the jet pipe structure and at the other end to the member.

3. An arrangement as claimed in claim 2 further comprising shroud means adjacent to the flexible ligament adapted to shield the ligament from the hot gas stream.

4. An arrangement as claimed in claim 3 wherein the shroud means is adapted to direct cooling air towards the flexible ligament.

5. An arrangement as claimed in claim 4 further comprising means for ducting cooling air from an engine bypass duct into the shroud means.

* * * * *